US009140146B2

(12) United States Patent
Hartmann et al.

(10) Patent No.: US 9,140,146 B2
(45) Date of Patent: Sep. 22, 2015

(54) STEAM GENERATOR FOR A RANKINE CYCLE

(71) Applicant: Eberspächer Exhaust Technology GmbH & Co. KG, Neunkirchen (DE)

(72) Inventors: Marc Hartmann, Rottenburg am Neckar (DE); Stefan Geser, Stuttgart (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 129 days.

(21) Appl. No.: 13/804,998

(22) Filed: Mar. 14, 2013

(65) Prior Publication Data

US 2013/0239571 A1 Sep. 19, 2013

(30) Foreign Application Priority Data

Mar. 15, 2012 (DE) ..... 10 2012 204 126

(51) Int. Cl.

| | |
|---|---|
| ***F01K 23/10*** | (2006.01) |
| ***F28F 13/00*** | (2006.01) |
| ***F28F 9/26*** | (2006.01) |
| ***F28F 27/02*** | (2006.01) |

(Continued)

(52) U.S. Cl.

CPC ..... *F01K 23/10* (2013.01); *F01K 23/065* (2013.01); *F28D 7/0016* (2013.01); *F28D 21/0003* (2013.01); *F28F 9/26* (2013.01); *F28F 13/00* (2013.01); *F28F 27/02* (2013.01); *F01N 5/02* (2013.01); *F28F 2250/06* (2013.01)

(58) Field of Classification Search

CPC ..... F28D 7/024; F28D 21/003; F28D 7/0016; F28F 27/02; F28F 13/00; F28F 9/26; F01K 23/10; F01K 23/065

USPC ..... 60/618, 320; 165/103, 41, 901, 156

See application file for complete search history.

(56) References Cited

U.S. PATENT DOCUMENTS 2,364,130 A * 12/1944 Clancy ..... 165/169
3,062,510 A * 11/1962 Percival ..... 165/10

(Continued)

FOREIGN PATENT DOCUMENTS

CN 1585884 A 2/2005
CN 101943088 A 1/2011

(Continued)

OTHER PUBLICATIONS

Chinese Office Action of May 4, 2015.

*Primary Examiner* — Thai Ba Trieu
*Assistant Examiner* — Ngoc T Nguyen
(74) *Attorney, Agent, or Firm* — McGlew and Tuttle, P.C.

(57) ABSTRACT

A steam generator (1) is provided for a Rankine cycle, especially for a waste heat recovery device (37) of an internal combustion engine (36), and preferably in a motor vehicle. The steam generator includes: a heat exchanger channel (2), in which a heat exchanger (3) is arranged, and a bypass channel (4) for bypassing the heat exchanger channel (2). A heating fluid can flow through the heat exchanger channel (2) and bypass channel (4) during the operation of the steam generator (1). A medium to be evaporated can flow through the heat exchanger (3) during operation of the steam generator (1). A compact structural shape with high energy efficiency is achieved with the heat exchanger channel (2) enveloping the bypass channel (4).

13 Claims, 4 Drawing Sheets

(51) Int. Cl.

| | |
|---|---|
| ***F28D 7/00*** | (2006.01) |
| ***F28D 21/00*** | (2006.01) |
| ***F01K 23/06*** | (2006.01) |
| *F01N 5/02* | (2006.01) |

(56) References Cited

U.S. PATENT DOCUMENTS

| | | | | |
|---|---|---|---|---|
| 4,498,524 | A * | 2/1985 | Jacobsen | 165/103 |
| 8,006,651 | B2 * | 8/2011 | Veitch et al. | 165/168 |
| 8,517,084 | B2 * | 8/2013 | Kaspersen et al. | 165/103 |
| 2004/0159110 | A1 * | 8/2004 | Janssen | 62/77 |
| 2005/0133202 | A1 * | 6/2005 | Jorgensen et al. | 165/103 |
| 2005/0262842 | A1 * | 12/2005 | Claassen et al. | 60/618 |
| 2011/0131961 | A1 * | 6/2011 | Lee et al. | 60/320 |
| 2012/0144814 | A1 * | 6/2012 | Won et al. | 60/320 |

FOREIGN PATENT DOCUMENTS

| | | | | |
|---|---|---|---|---|
| CN | 101978140 | A | 2/2011 | |
| CN | 102086821 | A | 6/2011 | |
| DE | 10 2005 039 794 | A1 | 3/2007 | |
| DE | 102010039281 | A1 * | 6/2011 | F02G 5/02 |
| GB | 2143589 | A * | 2/1985 | F01K 23/06 |
| WO | WO 8400193 | A1 * | 1/1984 | F01N 5/02 |

* cited by examiner

STEAM GENERATOR FOR A RANKINE CYCLE

CROSS REFERENCE TO RELATED APPLICATIONS

This application claims the benefit of priority under 35 U.S.C. §119 of German Patent Application DE 10 2012 204 126.5 filed Mar. 15, 2012, the entire contents of which are incorporated herein by reference.

FIELD OF THE INVENTION

The present invention pertains to a steam generator for a Rankine cycle, especially for a waste heat recovery device of an internal combustion engine, preferably in a motor vehicle. The present invention also pertains to a steam generator system, a waste heat recovery device as well as an internal combustion engine.

BACKGROUND OF THE INVENTION

Steam generators can be used, for example, in a Rankine cycle or in a Clausius-Rankine cycle to be able to evaporate the working medium of the respective cycle. Such a steam generator may basically be equipped with a heat exchanger or be set up like a heat exchanger.

A waste heat recovery device that operates on the basis of a Rankine cycle or a Clausius-Rankine cycle usually comprises a waste heat recovery circuit, in which a suitable working medium circulates. In the waste heat recovery circuit, usually a steam generator for evaporating the working medium, an expansion engine for releasing the working medium, a condenser for condensing the working medium as well as a delivery means for driving the working medium in the waste recovery circuit are arranged in the flow direction of the working medium one behind the other. By means of such a waste heat recovery device, waste heat occurring, for example, in an internal combustion engine can be utilized to improve the energy efficiency of the internal combustion engine. For example, mechanical energy can be produced by means of the expansion engine, which can be used for supporting the internal combustion engine. It is likewise possible to produce current by means of the expansion engine in conjunction with a generator, which, especially in conjunction with a suitable energy storage means, can be utilized for supplying electrical components of the internal combustion engine or of a vehicle equipped with the internal combustion engine. So that such a waste heat recovery device has an especially high energy efficiency, the transmission of heat between a heating fluid, whose heat shall be utilized as waste heat, and the working medium of the waste heat recovery circuit is of great importance.

A heat exchanger means for a waste system of an internal combustion engine in a motor vehicle has become known from DE 10 2005 039 794 A1, whereby this waste gas heat exchanger has a heat exchanger channel, in which a heat exchanger is arranged. The heat exchanger means also has a bypass channel for bypassing the heat exchanger channel. For reducing the production costs of the heat exchanger means, the two channels are arranged, such that the one channel envelops the other channel. In the prior-art heat exchanger means, the heat exchanger is fluidically bound in a cooling circuit of the internal combustion engine, so that the internal combustion engine can be heated up rapidly via the waste gas, for example, in case of a cold start of the internal combustion engine. Enough heat is likewise available in the waste gas to heat a passenger compartment of a motor vehicle equipped with the internal combustion engine in the usual manner via the cooling circuit of the internal combustion engine.

SUMMARY OF THE INVENTION

An object of the present invention is to provide an improved embodiment for a steam generator or for a waste heat recovery device.

The steam generator according to the present invention is designed with a heat exchanger channel, in which a heat exchanger is arranged, and with a bypass channel for bypassing the heat exchanger channel, whereby the heat exchanger channel envelops the bypass channel. The steam generator is configured in this case such that the working medium to be evaporated can be fed through the heat exchanger, while a heating fluid, which supplies the heat needed to evaporate the working medium, can be fed through the heat exchanger channel, so that it impinges on or flows around the heat exchanger arranged therein. It is especially important in this case that the bypass channel is arranged centrally, so that fluid can flow through with low flow resistance. In this way, for example, the risk of overheating of the heat exchanger can be reduced in case only comparatively little heat is needed to evaporate the working medium.

According to one advantageous embodiment, the heat exchanger can be arranged about the bypass channel in a coil-like manner. In this way, an especially compact design arises for the steam generator according to the present invention, on the one hand, and, on the other hand, the steam generator according to the present invention can be technically achieved in a relatively simple manner, which has a favorable effect on the production costs of the steam generator.

To design the steam generator in an especially compact design, the steam generator may comprise an essentially tubular housing, in which the bypass channel, which has an essentially tubular design, is arranged, so that the heat exchanger channel is formed by a ring-shaped interspace arranged between the bypass channel and the housing. The heat exchanger is then arranged in this ring-shaped space.

In an especially simple-to-produce and thus cost-effective embodiment, it is possible to think that the heat exchanger is designed as a tube coil, which extends in a coil-like manner along an outer circumferential surface of the bypass channel. The tube coil may especially be designed in this case, such that it can be removed from the steam generator and installed again with little effort. In this way, an especially maintenance-friendly embodiment of the steam generator according to the present invention is possible.

In an embodiment variant, the heat exchanger lies unfastened on the outer circumferential surface of the bypass channel and is only fastened in end areas to the bypass channel. In this way, mechanical stresses based on a heat-related expansion or contraction of the bypass channel or of the heat exchanger caused by changes in temperature, especially caused by differences in temperature between the heat exchanger and the bypass channel are prevented or at least reduced.

To guarantee that a heat-related expansion of the heat exchanger in the direction of the housing cannot lead to undesired mechanical stresses in case of contact of the heat exchanger with the housing, the heat exchanger can be arranged spaced apart from the housing at least between its end areas in an embodiment variant. The individual coils or windings within the tube coil may also be designed, such that adjacent coils do not touch axially at least in the cold state.

A thermal layer of insulation, especially made of metal foam, is preferably arranged between the heat exchanger channel and the bypass channel. In this way, the thermal insulation between the heat exchanger channel and the bypass channel is markedly improved.

To improve the thermal interaction between a heating fluid flowing through the heat exchanger channel, especially waste gas, and a working medium flowing through the heat exchanger, a plurality of disk-like ribs can be designed on an outer circumferential surface of the tube coil in an especially preferred embodiment, whereby each rib can project from the outer circumferential surface of the tube coil in the radial direction. A coil-like circumferential rib arrangement is likewise conceivable.

The steam generator may preferably have an inlet area and an outlet area, in each of which a perforation is preferably designed. This may especially be arranged in the bypass channel, which has an essentially tubular design, but, as an alternative, it may be embodied in the form of a separate piece of tube. In this way, it can be guaranteed that a waste gas entering the waste gas heat exchanger can be selectively fed both to the heat exchanger channel and to the bypass channel or be discharged both from the heat exchanger channel and from the bypass channel. The inlet area and the outlet area can thus perform the function of a fluid shunt for the waste gas entering the heat exchanger means or exiting from same.

Especially advantageous is an embodiment, in which the bypass channel is arranged axially aligned with a joint inlet and/or with a joint outlet of the steam generator, such that the heating fluid can flow through the steam generator almost free from deflections, especially in a straight line, when it follows the bypass channel, as a result of which an extremely low flow resistance can be achieved for this case. The bypass channel preferably has essentially the same flow cross section as said inlet and/or said outlet.

The bypass channel preferably has a control member for opening and closing the bypass channel. In this way, a heating fluid entering the steam generator can be fed through the bypass channel or through the heat exchanger channel. When the control member is open, the heating fluid, preferably waste gas of the internal combustion engine, follows the bypass channel, since this [bypass channel] does not contain a heat exchanger and thus has a markedly lower flow resistance than the heat exchanger channel.

In an especially preferred embodiment, the control member may be designed as a rotatable bypass valve, especially a butterfly valve, which can be rotated between an open position, in which the bypass channel is open, and a closed position, in which the bypass channel is closed. This makes possible a simple closing and opening of the bypass channel.

In an embodiment variant, the control member may assume one or more optional intermediate positions in relation to the open or closed position, in which the bypass channel is only partly open, especially with a certain degree of opening.

For making possible an especially simple technical embodiment of the control member, it can be arranged in the inlet area or in the outlet area of the bypass channel.

The present invention also pertains to a steam generator system for use in a motor vehicle, comprising a first and a second steam generator, each of the type described above, which are arranged next to one another and essentially parallel to one another. The steam generator system also comprises a coupling element on the inlet side, preferably designed as a Y-tube, with a waste gas input and a first coupling opening, which is in fluidic connection with an inlet opening of the first steam generator as well as with a second coupling opening, which is in fluidic connection with an inlet opening of the second steam generator.

The steam generator system also comprises a coupling element on the outlet side, preferably designed as a Y-tube, with a waste gas output and a first coupling opening, which is in fluidic connection with the outlet opening of the first steam generator, as well as with a second coupling opening, which is in fluidic connection with the outlet opening of the second steam generator. By means of such a steam generator system, an especially effectively operating and at the same time compact steam generator means is achieved, which, in addition, can be integrated especially well in the installation space available in an underbody of a motor vehicle.

In an embodiment that can be produced in a technically especially simple manner, the steam generator system has a joint feed connection and a joint return flow connection, each of which is in fluidic connection with the end areas of the heat exchanger of the first and second steam generators.

In an especially preferred embodiment, the steam generator system has a drive unit for the joint driving of the two control members of the first and second steam generators. Such a steam generator system can be produced in a technically especially simple and thus also especially cost-effective manner.

A waste heat recovery device according to the present invention, especially for an internal combustion engine, preferably in a motor vehicle, comprises a waste heat recovery circuit, in which a working medium circulates, a steam generator of the type described above or a steam generator system of the type described above for evaporating the working medium arranged in the waste heat recovery circuit, an expansion engine arranged in the heat recovery circuit downstream of the steam generator or downstream of the steam generator system for releasing the working medium, a condenser arranged in the waste heat recovery circuit downstream of the expansion engine for condensing the working medium and a delivery means arranged in the waste heat recovery circuit downstream of the condenser for driving the working medium in the circuit. Also, the heat exchanger of the steam generator or the heat exchangers of the steam generator is/are each fluidically bound in the waste heat recovery circuit, while during operation of the waste heat recovery device, waste gas of the internal combustion engine flows through the heat exchanger channel of the steam generator or the heat exchanger channels of the steam generator system, which is characterized, moreover, by a high energy efficiency.

Thus, the present invention also pertains to a steam generator or a steam generator system, which is characterized by a use in a waste heat recovery device or in a Rankine cycle.

An internal combustion engine according to the present invention, especially in a motor vehicle, now comprises a waste system, which has at least one waste gas line for discharging waste gas from the internal combustion engine, and a waste heat recovery device of the type described above, wherein the heat exchanger channel of the steam generator or the heat exchanger channels of the heat exchanger system is/are each fluidically bound in the waste gas line of the internal combustion engine. These features likewise lead to a compact construction and a high efficiency, which favors integration in a mobile application, preferably in a vehicle. Accordingly, the present invention also pertains to a motor vehicle, which has an internal combustion engine of the above-described type for driving the vehicle.

Other important features and advantages of the present invention appear from the subclaims, from the drawings and from the corresponding description of the figures based on the drawings.

It is obvious that the features mentioned above and still to be explained below can be used not only in each combination indicated, but also in other combinations or alone, without going beyond the scope of the present invention.

Preferred embodiments of the present invention are shown in the drawings and are explained in detail in the following description, wherein identical reference numbers refer to identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
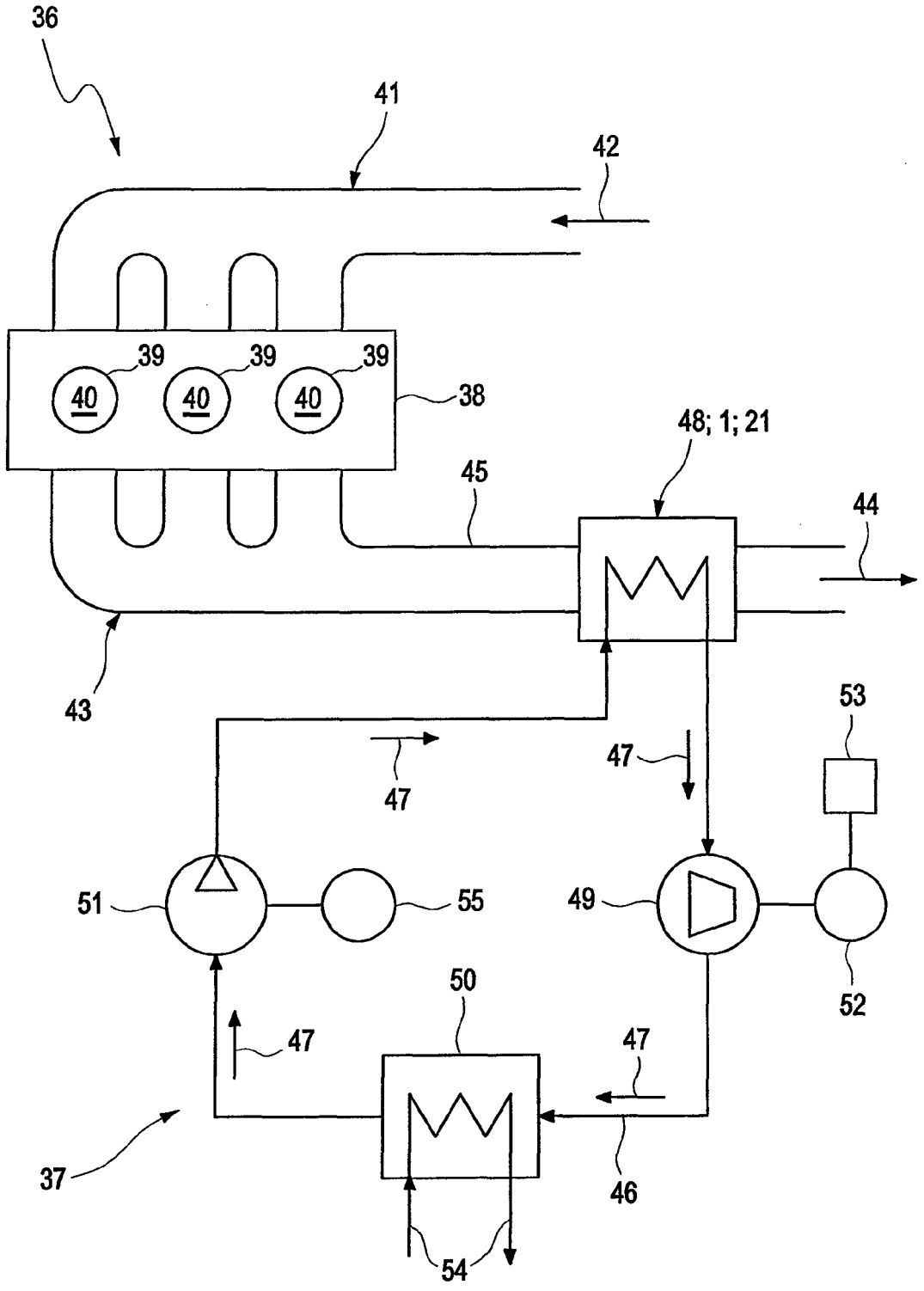
FIG. 1 is a highly simplified, circuit diagram-like schematic diagram of an internal combustion engine with a waste heat recovery device according to the invention.

According to FIG. 1, an internal combustion engine 36 of an otherwise not shown motor vehicle can be equipped with a waste heat recovery device 37. The internal combustion engine 36 has an engine block 38 which is shown here only as an example with three cylinders 39, whose combustion chambers 40 are supplied with fresh air 42 by means of a fresh air system 41. A waste system 43 provides for a removal of waste gas 44 of the internal combustion engine 36, which forms in the combustion chambers 40 during the operation of the internal combustion engine 36. For this, the waste system 43 comprises at least one waste gas line 45. The waste gas 44 discharged therein contains heat, which shall be utilized by means of the waste heat recovery device 37. The waste heat recovery device 37 comprises a waste heat recovery circuit 46, in which a working medium 47 circulates. The waste heat recovery device 37 preferably operates according to the principle of a Rankine cycle or according to the principle of a Clausius-Rankine cycle. Accordingly, the waste heat recovery device 37 comprises an evaporator 48 arranged in the waste heat recovery circuit 46 for evaporating the working medium 47. Further, an expansion engine 49 for releasing the working medium 47, a condenser 50 for condensing the working medium 47 and a delivery means 51 for driving the working medium 47 in the waste heat recovery circuit 46 are arranged following the evaporator 48 in the waste heat recovery circuit 46 in the flow direction of the working medium 47. In the example of FIG. 1, the expansion engine 49 drives a generator 52 to thus produce electric energy. This energy can be stored, for example, in a storage means 53, which is designed, for example, as a battery. The condenser 50 can be connected, for example, to a cooling circuit 54, in which it may preferably be the cooling circuit of the internal combustion engine 36. The delivery means 51 is, for example, a volumetric pump and can be driven by means of a drive motor 55.

The evaporator 48 makes possible the heat-transmitting coupling between the waste system 43 and the waste heat recovery circuit 46. For this, the evaporator 48 is bound in the waste gas line 45, on the one hand, and in the waste heat recovery circuit 46, on the other hand. The evaporator 48 is advantageously designed as a steam generator 1 or as a steam generator system 21 in the internal combustion engine 36 presented here or in the waste heat recovery device 37 presented here. The steam generator is explained in detail below with reference to FIG. 2. The steam generator system 21 is explained in detail below based on FIGS. 3 and 4, wherein the steam generator system comprises at least two steam generators 1.

Figure 2:
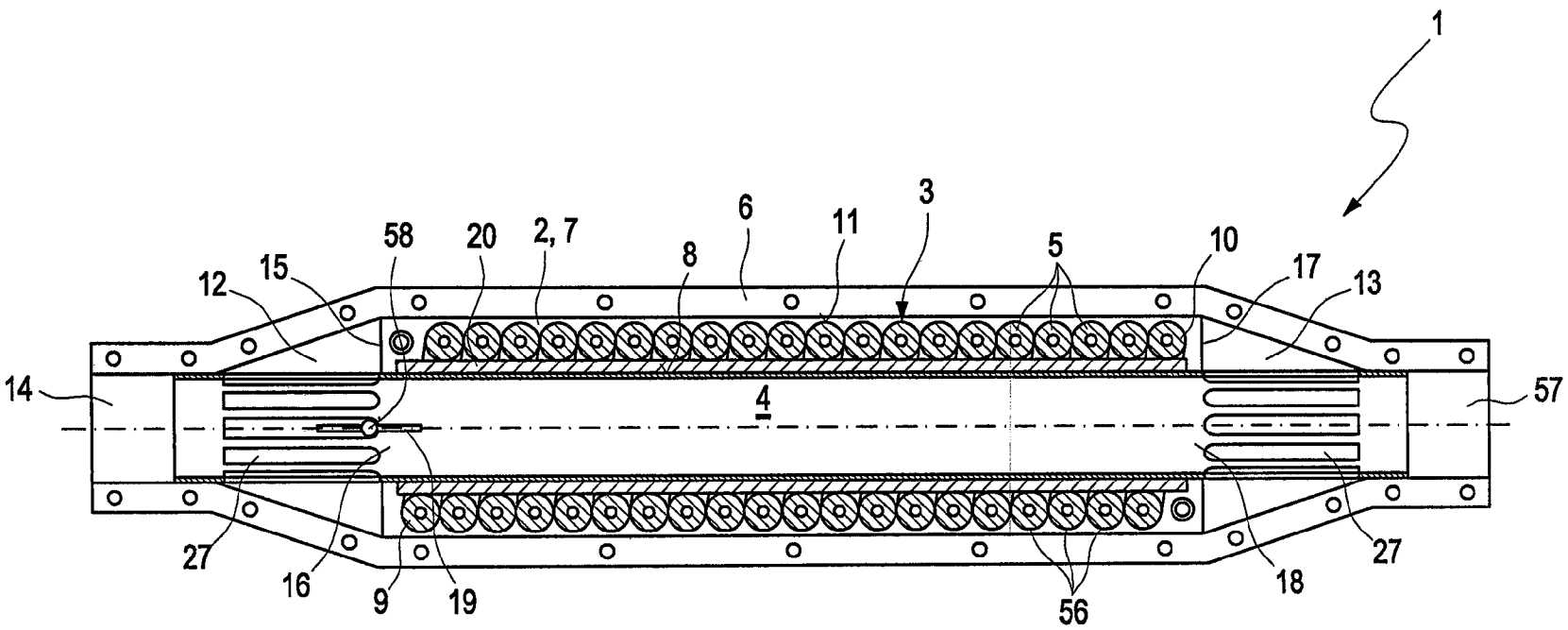
FIG. 2 is a schematic longitudinal sectional view showing an exemplary embodiment of a steam generator according to the invention.

In the view of FIG. 2, such a steam generator is shown in a longitudinal sectional view and is designated by 1. The steam generator 1 comprises a heat exchanger channel 2, in which a heat exchanger 3 is arranged. The steam generator 1 also comprises a bypass channel 4, which has an essentially tubular design, for bypassing the heat exchanger channel 2. The heat exchanger channel 2 envelops the bypass channel 4, whereby the heat exchanger 3 is arranged in a coil-like manner about the bypass channel 4. The coil-like heat exchanger 3 in this case has a plurality of coils or windings 5, which are arranged in the heat exchanger channel 2, winding around the bypass channel 4.

In the exemplary embodiment according to FIG. 2, the steam generator 1 is designed with a housing 6, in which is arranged the bypass channel 4, which has an essentially tubular design. A tubular interspace 7, which in turn forms the heat exchanger channel 2, is formed between the housing 6 and an outer circumferential surface 8 of the bypass channel 4.

In the exemplary embodiment, the heat exchanger 3 is designed as a tube coil, which extends in a coil-like manner along the outer circumferential surface 8 of the bypass channel 4. In the exemplary embodiment, a concentric arrangement of the bypass channel 4 in the interior of the housing 6 is shown; however, an off-center arrangement for the bypass channel 4 is basically also conceivable.

Also in the exemplary embodiment, a flow cross section of the bypass channel 4 has a circular design, whereas heat exchanger channel 2 has a flow cross section that has a ring-shaped design. However, the geometries of the cross sections are basically freely selectable, such that the outer contour of steam generator 1 defined by the housing 6 can be adapted especially to respective installation conditions, for example, when installing in a motor vehicle.

The heat exchanger 3 can only be fastened in end areas 9, 10 to the housing 6 or to the bypass channel 4, whereas it can lie between the end areas 9, 10 only on the outer circumferential surface 8 of the bypass channel 4. In a variant of the exemplary embodiment, which is shown in the view of FIG. 2, a thermal layer of insulation 20 for improved thermal insulation of the heat exchanger channel 2 against the bypass channel 4 is arranged between the heat exchanger 3, which is designed as tube coil, and the outer circumferential surface 8 of the bypass channel 4. This layer of insulation 20 may especially be made of metal foam. In a simplified variant, such a thermal layer of insulation 20 may be omitted.

Disk-like ribs 56 can be designed on an outer circumferential surface 11 of the heat exchanger 3, designed as a tube coil, in a variant of the exemplary embodiment, whereby each rib 56 projects in the radial direction from the outer circumferential surface 11 of the tube coil. The effectively available interaction surface for the heat exchange of the waste gas 44 flowing through the heat exchanger channel 2 with the working medium 47 flowing through the heat exchanger 3 can be increased by means of such ribs 56 and thus the efficiency of the steam generator 1 can be improved.

The steam generator 1 also has an inlet area 12 and an outlet area 13, by means of which the steam generator 1 can be bound in a simple manner in the waste system 43, especially for a motor vehicle. The inlet area 12 or/and outlet area 13 may especially have a funnel-shaped design in this case. Within the steam generator 1, the inlet area 12 connects a waste gas inlet 14 of the steam generator 1 to a heat exchanger inlet 15 and to a bypass inlet 16. Correspondingly, the outlet area 13 in the interior of the steam generator 1 connects a waste gas outlet 57 to a heat exchanger outlet 17 and to a bypass outlet 18.

In a variant, inlet area 12 or/and outlet area 13 may each have a perforation 27, by means of which the waste gas 44 entering the steam generator 1 via the waste gas inlet 14 can be distributed into the heat exchanger channel 2 or bypass channel 4. In a variant, the perforation 27 may be designed directly in an axial end section of the tubular bypass channel 4, or, as an alternative, be embodied in the form of a separate piece of tube, which is arranged upstream or downstream of the bypass channel 4 in the housing 6. This correspondingly applies mutatis mutandis on the output side for a discharge of the waste gas 44 from the steam generator 1 upstream of the waste gas outlet 57.

Furthermore, the steam generator 1 of the exemplary embodiment may comprise a control member 19 for the selective opening or closing of the bypass channel 4. In the exemplary embodiment, the control member 19 is designed as a rotatable bypass valve, especially as a centrally mounted butterfly valve, which can be rotated between an open position, in which the bypass channel 4 is open, and a closed position, in which the bypass channel 4 is closed. In the view of FIG. 2, the bypass valve 19 is in the open position.

The bypass valve 19 may also especially assume any intermediate positions in relation to the open or closed position, such that the bypass channel 4 is only partly open. A desired effective opening cross section for the bypass channel 4 is achieved in this case by such an intermediate position of the bypass valve 19. For driving the bypass valve 19 or the control member 19, this can be connected nonrotatably to a drive shaft 58. Such a drive shaft 58 may additionally especially be carried out transversely to a longitudinal direction of the bypass channel 4 through the heat exchanger channel 2 and may be connected nonrotatably to an actuating drive (not shown) outside the housing 6 of the steam generator 1. By means of such an actuating drive, the drive shaft 58 can be actuated and via this the control member 19 can be actuated in a rotating manner, in order to move the control member 19 between the open and closed positions.

In the exemplary embodiment, the control member 19 is arranged in the area of the bypass inlet 16. However, the control member 19 may basically be arranged at any desired point of the bypass channel 4, especially also in an area of the bypass outlet 18.

In case the steam generator 1 is bound in waste heat recovery circuit 46, which has a heat demand, the waste gas 44 entering the steam generator 1 is fed into the heat exchanger channel 2 by means of the control member 19. For this, the control member 19 is moved into the closed position, such that the bypass channel 4 is closed for the flow of waste gas 44. In this way, the heat exchanger 3 is impinged on with hot waste gas 44, as a result of which the desired input of heat into the working medium 4 of the waste heat recovery circuit 46 is achieved. A waste gas 44 cooled off in this way may again flow out from same via the outlet area 13 of the steam generator 1.

In case the waste heat recovery circuit 46 has no heat demand, the control member 19 is moved into the open position, such that the bypass channel 4 is open for the flow of waste gas 44. Since the open bypass channel 4 typically has a markedly lower flow resistance than the heat exchanger channel 2, the waste gas 44 entering the steam generator 1 preferably and mainly flows through the bypass channel 4. As a result, the discharge of heat at the heat exchanger 3 due to the waste gas 44 flowing through the heat exchanger channel 2 is negligible.

The view of FIG. 3 now shows a steam generator system 21, which comprises a first and a second steam generator 1 of the type described above, which are designated below by 22 and 23, respectively. By means of such a steam generator system 21, an especially high evaporation capacity can be achieved in a compact design. In order to guarantee an as compact as possible construction of the steam generator system 21, the first and second steam generators 22, 23 of the steam generator system 21 are arranged next to one another and essentially parallel to one another. Also, they are bound into the waste system 43, such that waste gas 44 flows through them in parallel.

The waste gas 44 can be fed into or discharged from the steam generator system 21 by means of an inlet and outlet coupling element 28, 29, each designed as a Y-tube, which brings the first steam generator 22 into fluidic connection with the second steam generator 23 in their respective inlet or outlet area 12, 13. Such an inlet or outlet coupling element 28, 29 is obvious from the view of FIG. 4, which shows the steam generator system 21 with a transparent or omitted housing 6. The inlet or outlet coupling element 28, 29 may function in the manner of a fluid shunt.

The inlet coupling element 28 has a waste gas input 30 with a first coupling opening 31, which is in fluidic connection with the inlet opening of the first steam generator 22, as well as a second coupling opening 32, which is in fluidic connection with the inlet opening of the second steam generator 23. The outlet coupling element 29 has a waste gas output 33 with a first coupling opening 34, which is in fluidic connection with the outlet opening of the first steam generator 22, as well as a second coupling opening 35, which is in fluidic connection with the outlet opening of the second steam generator 23.

Figure 3:
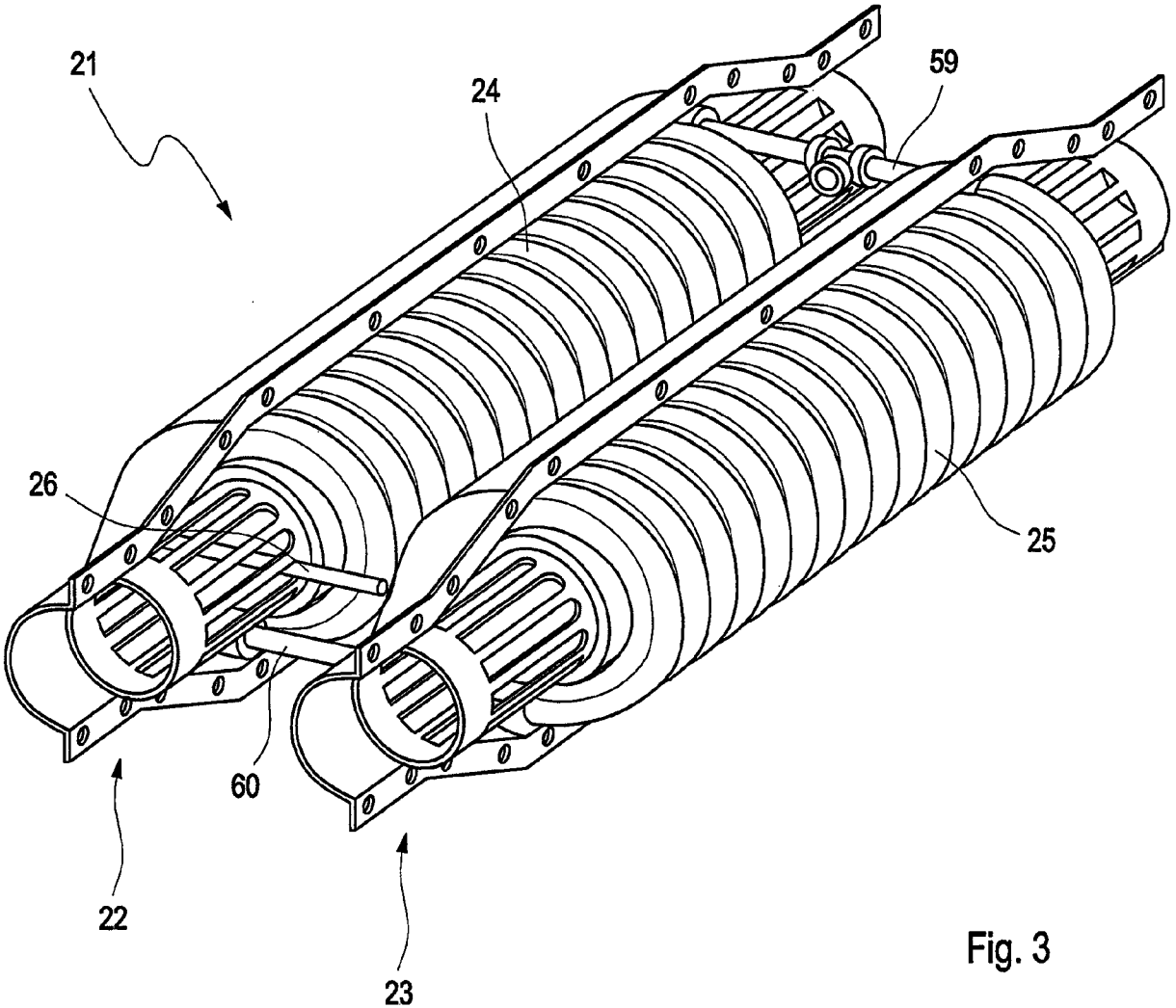
FIG. 3 is a schematic isometric view showing an exemplary embodiment of a steam generator system according to the invention.
Figure 4:
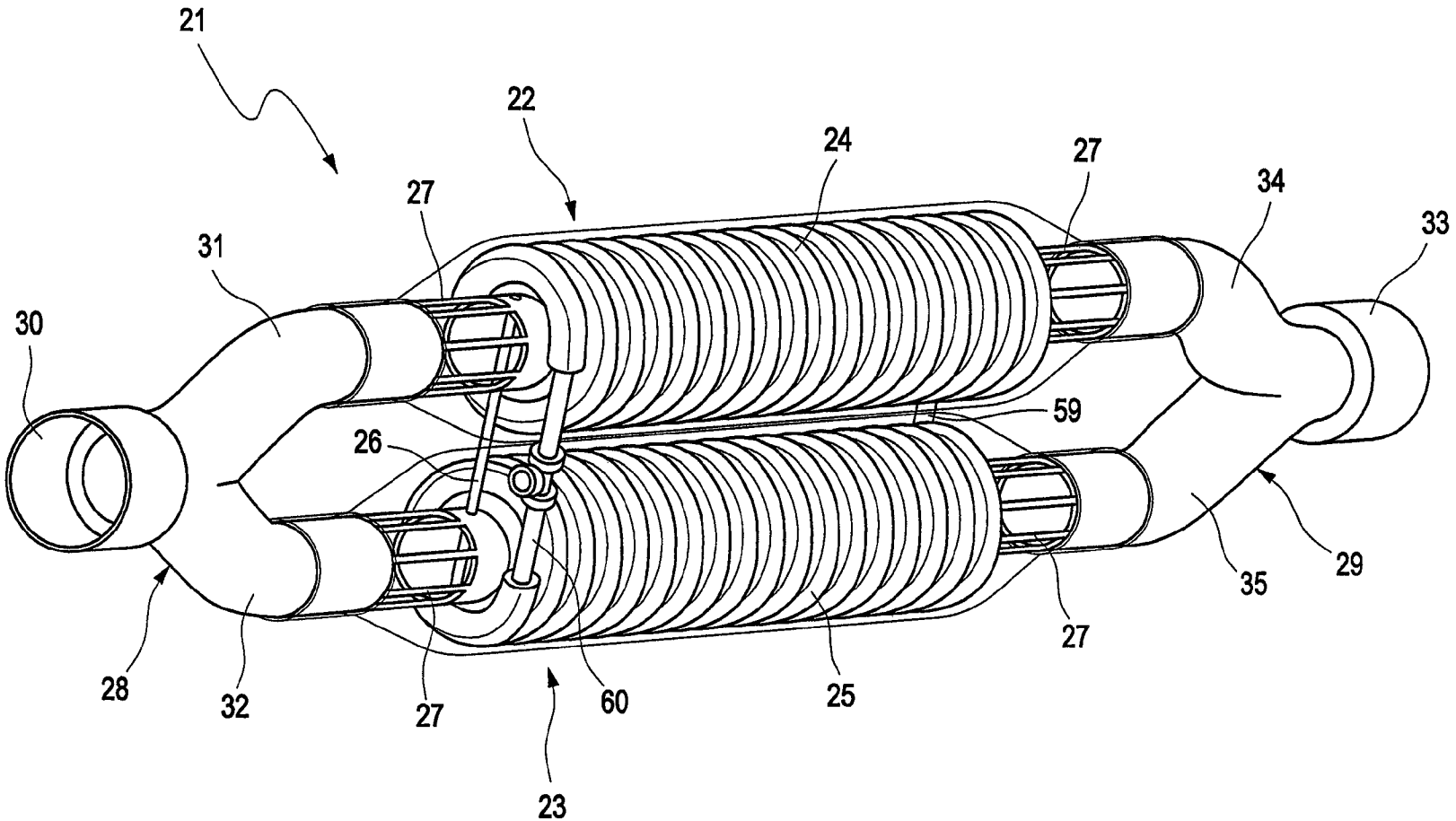
FIG. 4 is a schematic isometric view showing the exemplary embodiment of the steam generator system according to FIG. 3 with an inlet and an outlet coupling element.

According to the exemplary embodiment of FIGS. 3 and 4, the heat exchangers 24, 25, which are designed as tube coils, of the first and second steam generators 22, 23 are arranged in a coil-like manner along an outer circumferential surface of the bypass channels 4 of the first and second steam generators 22, 23 in a direction of rotation opposite one another. However, an identical direction of rotation of the two heat exchangers 24, 25 is also possible in variants.

In the exemplary embodiment according to FIGS. 3 and 4, the steam generator system 21 has a joint feed connection 59 and a joint return flow connection 60, each of which is in fluidic connection with the two end areas 9, 10 of the heat exchangers 24, 25 of the first and second steam generators 22, 23. In this way, the working medium can be fed simultaneously to the first and second heat exchangers 24, 25 of the first and second steam generators 22, 23 in a manner that is technically simple to embody.

In the view of FIGS. 3 and 4, a drive shaft 26 is also shown, by means of which both the control member 19 (not shown in FIG. 3) of the first steam generator 22 and of the second steam generator 23 can be actuated simultaneously. For this, the drive shaft 26 may be connected nonrotatably to a joint drive unit (likewise not shown in FIG. 3). The joint drive shaft 26 can especially be nonrotatably connected to the respective drive shaft 58 of the respective control member 19 or replace the two individual drive shafts 58.

In the steam generator 1 of FIG. 2 and in the steam generator system 21, the paths for the waste gas 44 and the working medium 46 are advantageously switched using the counterflow principle.

While specific embodiments of the invention have been shown and described in detail to illustrate the application of the principles of the invention, it will be understood that the invention may be embodied otherwise without departing from such principles.

What is claimed is:

1. A steam generator for a Rankine cycle for a waste heat recovery device of an internal combustion engine in a motor vehicle, the steam generator comprising:

a heat exchanger;

a heat exchanger channel in which the heat exchanger is arranged;

a bypass channel for bypassing the heat exchanger channel;

a heating fluid flowing through the heat exchanger channel and the bypass channel during the operation of the steam generator;

a medium to be evaporated flowing through the heat exchanger during the operation of the steam generator, wherein the heat exchanger channel envelops the bypass channel;

a tubular steam generator housing which encloses the heat exchanger channel, wherein the heat exchanger is arranged, at least between heat exchanger end areas, radially spaced apart from the steam generator housing enclosing the heat exchanger channel.

2. A steam generator in accordance with claim 1, wherein:

the heat exchanger being fastened to the bypass channel only at ends of said heat exchanger and otherwise lies, between the heat exchanger end areas, unfastened on an outer circumferential surface of the bypass channel.

3. A steam generator for a Rankine cycle for a waste heat recovery device of an internal combustion engine in a motor vehicle, the steam generator comprising:

a heat exchanger;

a heat exchanger channel in which the heat exchanger is arranged;

a bypass channel for bypassing the heat exchanger channel;

a heating fluid flowing through the heat exchanger channel and the bypass channel during the operation of the steam generator;

a medium to be evaporated flowing through the heat exchanger during the operation of the steam generator, wherein the heat exchanger channel envelops the bypass channel, the heat exchanger being fastened to the bypass channel only in heat exchanger end areas and otherwise lies, between the heat exchanger end areas, unfastened on an outer circumferential surface of the bypass channel; and an tubular steam generator housing which encloses the heat exchanger channel, wherein the heat exchanger is arranged, at least between heat exchanger end areas, radially spaced apart from the steam generator housing enclosing the heat exchanger channel.

4. A steam generator in accordance with claim 3, wherein the heat exchanger is arranged in a coil-like manner about the bypass channel.

5. A steam generator in accordance with claim 3, wherein:

the bypass channel has a tubular design, the heat exchanger channel being formed by a ring-shaped interspace arranged between the bypass channel and the housing, the heat exchanger being arranged in the ring-shaped interspace.

6. A steam generator in accordance with claim 3, wherein the heat exchanger comprises a tube coil which extends in a coil-like manner along an outer circumferential surface of the bypass channel.

7. A steam generator in accordance with claim 6, wherein a plurality of disk-like, separate ribs are formed on an outer circumferential surface of the tube coil, whereby each rib projects in a radial direction from the outer circumferential surface of the tube coil.

8. A steam generator in accordance with claim 3, further comprising a thermal layer of insulation made of a metal foam, the thermal layer of insulation being arranged between the heat exchanger channel and the bypass channel.

9. A steam generator in accordance with claim 3, wherein:

the bypass channel includes a perforation through which the heat exchanger channel is fluidically connected with the bypass channel to form a steam generator inlet area the bypass channel includes a perforation through which the heat exchanger channel is fluidically connected with the bypass channel to form a steam generator outlet area.

10. A steam generator in accordance with claim 3, wherein the bypass channel comprises a control member for opening and closing the bypass channel.

11. A motor vehicle internal combustion engine waste heat recovery device comprising:

a waste heat recovery circuit in which a working medium circulates;

a steam generator comprising a heat exchanger, a heat exchanger channel in which the heat exchanger is arranged, a bypass channel for bypassing the heat exchanger channel, a heating fluid flowing through the heat exchanger channel and the bypass channel during the operation of the steam generator and the working medium to be evaporated flows through the heat exchanger during the operation of the steam generator, the heat exchanger being fastened to the bypass channel only at ends of said heat exchanger and otherwise lies, between the heat exchanger end areas, unfastened on an outer circumferential surface of the bypass channel, an tubular steam generator housing which encloses the heat exchanger channel, wherein the heat exchanger is arranged, at least between heat exchanger end areas, radially spaced apart from the steam generator housing enclosing the heat exchanger channel, wherein the heat exchanger channel envelops the bypass channel, the steam generator system being arranged in the waste heat recovery circuit for evaporating the working medium;

an expansion engine arranged in the waste heat recovery circuit downstream of the steam generator for releasing the working medium;

a condenser arranged in the waste heat recovery circuit downstream of the expansion engine for condensing the working medium;

a delivery means arranged in the waste heat recovery circuit downstream of the condenser for driving the working medium in the waste heat recovery circuit, wherein the heat exchanger are fluidically bound in the waste heat recovery circuit, and wherein during operation of the waste heat recovery device, waste gas flows through the heat exchanger channel.

12. A waste heat recovery device according to claim 11, further comprising:

a second steam generator comprising a second steam generator heat exchanger, a second steam generator heat exchanger channel in which the second steam generator heat exchanger is arranged, a second steam generator bypass channel for bypassing the second steam generator heat exchanger channel, heating fluid flowing through the second steam generator heat exchanger channel and the second steam generator bypass channel during the operation of the steam generator and medium to be evaporated flowing through the second steam generator heat exchanger during the operation of the second steam generator, wherein the second steam generator heat exchanger channel envelops the second steam generator bypass channel, wherein the second steam generator heat exchanger is fluidically bound in the waste heat recovery circuit, and wherein during operation of the waste heat recovery device, waste gas flows through the second steam generator heat exchanger channel.

13. A waste heat recovery device according to claim 11, further comprising:

an internal combustion engine in a motor vehicle, the internal combustion engine comprising a waste system with at least one waste gas line discharging waste gas of the internal combustion engine, wherein the heat exchanger channel of the steam generator is fluidically bound in the waste gas line.

* * * * *